US010508462B2

(12) United States Patent
Binder

(10) Patent No.: US 10,508,462 B2
(45) Date of Patent: Dec. 17, 2019

(54) SWIMMING POOL HAVING AN INTEGRATED COUNTER-CURRENT SWIMMING SYSTEM

(71) Applicant: Siegfried Binder, Hameln (DE)

(72) Inventor: Siegfried Binder, Hameln (DE)

( * ) Notice: Subject to any disclaimer, the term of this patent is extended or adjusted under 35 U.S.C. 154(b) by 39 days.

(21) Appl. No.: 15/312,177

(22) PCT Filed: May 18, 2014

(86) PCT No.: PCT/DE2014/000254
§ 371 (c)(1),
(2) Date: Feb. 28, 2017

(87) PCT Pub. No.: WO2015/176694
PCT Pub. Date: Nov. 26, 2015

(65) Prior Publication Data

US 2017/0191281 A1 Jul. 6, 2017

(51) Int. Cl.
*E04H 4/12* (2006.01)
*A63B 69/12* (2006.01)
*E04H 4/00* (2006.01)

(52) U.S. Cl.
CPC ..... *E04H 4/12* (2013.01); *A63B 69/125* (2013.01); *E04H 4/0006* (2013.01)

(58) Field of Classification Search
CPC ..... A47K 7/024; A45D 40/00; B65D 85/70; E04H 4/12; E04H 4/0006; A63B 69/125
USPC ..... 4/606, 491, 492
See application file for complete search history.

(56) References Cited

U.S. PATENT DOCUMENTS 6,030,180 A * 2/2000 Clarey ..... A63B 69/125 417/18
6,729,799 B1 * 5/2004 Raike ..... E04H 4/0006 4/491

FOREIGN PATENT DOCUMENTS

| | | | |
|---|---|---|---|
| AT | 506 821 | A2 | 12/2009 |
| CH | 707 215 | A2 | 5/2014 |
| DE | 2319902 | A1 | 11/1974 |
| DE | 24 01 040 | A1 | 7/1975 |
| DE | 3143 322 | A1 | 5/1983 |
| DE | 10 2006 061 504 | B3 | 6/2008 |
| DE | 20 2011 106 999 | U1 | 2/2012 |
| DE | 202012 011034 | U1 | 3/2013 |
| FR | 2918290 | A1 | 1/2009 |

* cited by examiner

*Primary Examiner* — Tuan N Nguyen
(74) *Attorney, Agent, or Firm* — Horst M. Kasper, Esq.

(57) ABSTRACT

The present invention provides a swimming pool having an integrated counter-current swimming system (1) comprising a device (10) for generating a strong, adjustable flow in the water, which has a compact design and a relatively low power consumption. The device (10), comprising a brushless underwater DC motor (8) which is arranged in the inlet area of a flow channel (3), is arranged in a housing (35) which has an end element (36) at the front, wherein the exit face of the flow channel (3) in the device (10) is almost flush in the plane of the shaped end element (36). The underwater DC motor (8) and thus the drive (2) is of slim design, wherein the geometric ratio of the length thereof to the diameter of the drive housing should be no less than 3.3.

16 Claims, 5 Drawing Sheets

SWIMMING POOL HAVING AN INTEGRATED COUNTER-CURRENT SWIMMING SYSTEM

The present invention relates to a swimming pool having an integrated counter-current swimming system for generating a strong flow in a liquid medium, e.g., water, in particular with a device in a housing having a brushless free drive DC motor, and a special flow channel, where the underwater drive is arranged.

Such a device become known from the publication DE 20 2011 106 999 U1, which discloses a nozzle assembly for a counter-current swimming, which is embedded with its housing in the wall of the swimming pool and the direction of flow from the nozzle is provided in parallel to the water surface. Immediately before the exit of the water jet in the pool to avoid turbulence of the relatively small water jet of about 30-100 mm in diameter flow straightener in the form of tubular passageways arranged. Concentrically around the outlet opening of the flow rectifier, an annular suction opening is arranged, the surfaces of the inlet and outlet opening of the water are in a plane such as the swimming pool wall. At such small diameters of the water outlet, it is considered disadvantageous that a plurality required by nozzles to produce a useful as a counter-current swimming flow, whereby a relatively large demand for primary energy is needed and the design effort is not insignificant.

Further, an apparatus for generating a strong flow in a swimming pool has become known from DE 20 2012 011 034 U1, which has a compact design with a relatively small power consumption. In this apparatus consists of the drive from an underwater DC motor, which is arranged in the inlet region of a flow channel, wherein the ratio of the diameter (D) of the inlet opening to the diameter of the outlet opening (d) is not less than 1.3. The subsea DC motor and thus the driving is performed in a slender design, the geometric ratio of the length to the diameter of the drive housing is not less than 3.3.

Further, such devices are known in the prior art from the publication DE 33 13 549 A1. This document discloses an apparatus for producing a fluid jet, which, inter alia, can also be used in swimming pool for generating a flow. This device includes in its basic structure has an oval cylindrical portion, to which a perpendicularly disposed to the axis of the cylindrical portion section connects on one side with an outlet nozzle, wherein the rectangular array being adversely affected by the flow conditions and the applied energy requirements of the drive. Further, the water is drawn perpendicular to the direction of flow through the slot openings, which on the one hand negatively on the other hand has an adverse effect on the energy requirement of the drive and to the laminar flow within the device. Furthermore, the underwater motor is completely arranged in the cylindrical portion of the housing, which creates a high flow resistance within the cylindrical housing portion, consequently, a high energy is required to overcome this flow reconditions is required. About the appearance of the underwater motor information is not provided.

Further disclosed the document DE 10 2006 061 504 B3 a flow pump in a pear-shaped body, whose drive motor is fully disposed within the housing, wherein the propeller of the flow generated is arranged in the region of the outlet opening. Although disclosed in DE 10 2006 061 504 B3 as driving an electronically commutated brushless DC motor, but having only a relatively weak magnetic field (H) of a permanent magnet, which is insufficient to low energy to generate a strong current in the swimming pool.

Another device is in the art is known from the DE 24 01 040 which is to take a counter-current swimming system for swimming pools, in which a submersible motor is arranged in a tubular housing with its longitudinal axis parallel to the wall of the swimming pool. The outlet nozzle is rotated 90° to the longitudinal axis of the drive motor or of the tubular housing, wherein the cross-section of the water outlet nozzle relative to the cross section of the housing is tapered. The cross-sectional area of the nozzle is between 120 to 130 sq cm at an exit velocity of 1 m/sec with a power from 1 to 1.2 kW.

Known to be disadvantageous in the entire state of the art has become counter-current systems, it is perceived that the one part, the power of the flow generating units as compared to the flow velocity and the range of the effective flow is too high, and on the other hand it is to retrofit a swimming pool with a counter current system is too sophisticated. Further, it is to be regarded as disadvantageous that the design of the known in the prior art become comparable plants is too bulky, which increases costs unnecessarily.

In general, conventional counter-current systems for the private sector generally of the components centrifugal pump, inlet nozzles, one or more discharge nozzles, connection cables and pipes and an electrical controller. The water is sucked by the pump from the tank through one or more intake and discharged through nozzles at an accelerated rate in the basin again.

Such pump systems are working bar with pressures greater than 5 and require installed electrical power of 1.9 kW to 5.5 kW. The pumps are driven by conventional induction motors. The pump capacity is partly controlled by static frequency converters. Due to the system are the line seals and the shaft seal to constant wear and require at least an annual maintenance.

Starting from the set forth above prior art, the present invention seeks to reduce the power consumption of a flow unit for the same required power output and to make the construction of the flow unit so that it can be easily integrated into a swimming pool, with simultaneous maintenance and minimum wear of the unit.

This object is solved by the characterizing features of the main claims.

The swimming pool according to the invention with integrated counter-current system is equipped with a device for generating a strong adjustable flow in a liquid medium with an underwater drive which is arranged in the entry area of a particularly shaped flow channel. The flow channel has a large inlet opening and a small outlet opening to comparable. The drive consists essentially of a wear- and maintenance-free direct current motor, the housing of the underwater drive is arranged almost in half in the flow channel. The diameter ratio (D/d) of the inlet opening (D) to the outlet opening (d) should not be smaller than 1.7. To achieve advantageous flow conditions for entry of the liquid medium in the flow channel, the underwater drive to a length to diameter ratio 2 to 4 The integrated counter flow is characterized in that the exit surface of the flow channel nearly aligned in the plane of a molded closure element, which is arranged at the front of the housing.

It is advantageous that the closing element comprises a plurality of recesses, whose total area a flow rate of 50—ensures 160 sqm/h and a flow rate of no greater than 0.4 m/s.

It is also advantageous in that the clear width or diameter of a single recess in the closing element is not greater than 8 mm, for preventing that human body parts can be inserted in the recesses.

Advantageously, for maintaining the flow direction after the exit of the liquid medium from the outlet opening of the flow channel is that in the flow direction behind the propeller of the underwater drive at least one directional element is arranged, which largely prevents a turbulence of the fluid flow and ensures the direction constancy of flow is.

Furthermore, it is advantageous that the recess for the outlet opening of the flow channel is arranged approximately centrally in the surface of said molded closure element.

Another advantage is that the final element of a perpendicular to the surface mechanical load of at least 1390 N resists according to 140 kg without suffering permanent deformation.

It is furthermore advantageous that the edges of the final element are rounded and the surface of the end plate has no protruding screw.

It is also advantageous that the diameter d1 of the circular drive is small compared to the length L formed of the actuator, wherein the ratio of the length L to the diameter d1 should not be less than 2.7.

It is furthermore advantageous that the diameter d1 of the circular drive is formed as small as possible compared to the length L of the drive, for. Example, such that the ratio of length to diameter of between 2 to 4, preferably 3.1, wherein d1 is the diameter of the round drive between 45 mm and 85 mm, preferably 71 mm and the length L of the round drive between 100 mm and 300 mm, preferably at 217 mm.

The flow channel in this case has a flow-optimized geometry. The particularly airflow-friendly driving with an almost maintenance-free DC motor whose housing is arranged almost in half in the flow channel, and almost half outside the flow channel carries significantly to the low-resistance laminar flow within the flow channel.

Another aspect of the invention is that the underwater drive labeled for a device of a counter-current swimming in that the underwater drive has a DC motor, a shaft of a rotor between two camps of bearing sleeves is included of ceramic material, and during the running of the rotor between bearing sleeves storage and forms a film of water.

The inventive method for producing a strong adjustable flow in a liquid medium of a counter-current swimming uses a device as described above with a special drive, which uses a brushless and maintenance-free DC motor.

In this method, it is advantageous that the particular flow-friendly drive is arranged in the inlet region of the flow channel under water, at least one end of the drive is outside of the flow channel and the outer shape of the casing of the drive is particularly flow friendly designed with a sleek, low-maintenance drive.

Further, it is advantageous that the diameter ratio D/d of the entry opening D is the outlet opening d of the flow channel is not less than 1.7 z. B. that the diameter (d) of the outlet opening is between 100 mm and 200 mm, preferably at 144 mm and the diameter D of the inlet opening is between 200 mm and 300 mm, preferably 250 mm.

It is also advantageous that a brushless DC motor with a propeller is combined in a compact housing with flow-optimized geometry.

A significant advantage is seen in the fact that due to a special construction of the motor no shaft seals are needed because the interior of the engine with a liquid medium, e.g. Water is replenished, which minimizes the friction in the bearings.

It is also advantageous that the drive is designed as a. brushless direct current motor and with a wear-free sealing system.

It is also advantageous that the housing of the drive flow-friendly elements, z. B. Preferably at least one end side in the direction of flow S of the liquid medium.

A further advantage is the fact that the rotor of the electric drive has at least two permanent magnetic elements which produce a strong permanent magnetic field H, e.g. magnetic elements of rare earths.

It is furthermore advantageous that at least a part of the bearing of the shaft of the rotor is made of ceramic material.

The fact that the magnetic elements and the stator of the electric drive are embedded in a casting compound is particularly advantageous.

It is furthermore advantageous that the magnetic field of the stator generated due to an electronic control and is infinitely variable.

Further advantageous characteristic features are described in the dependent claims and the detailed description.

In what follows the invention will be described in greater detail with reference to drawings in detail. It shows:

Figure 1:
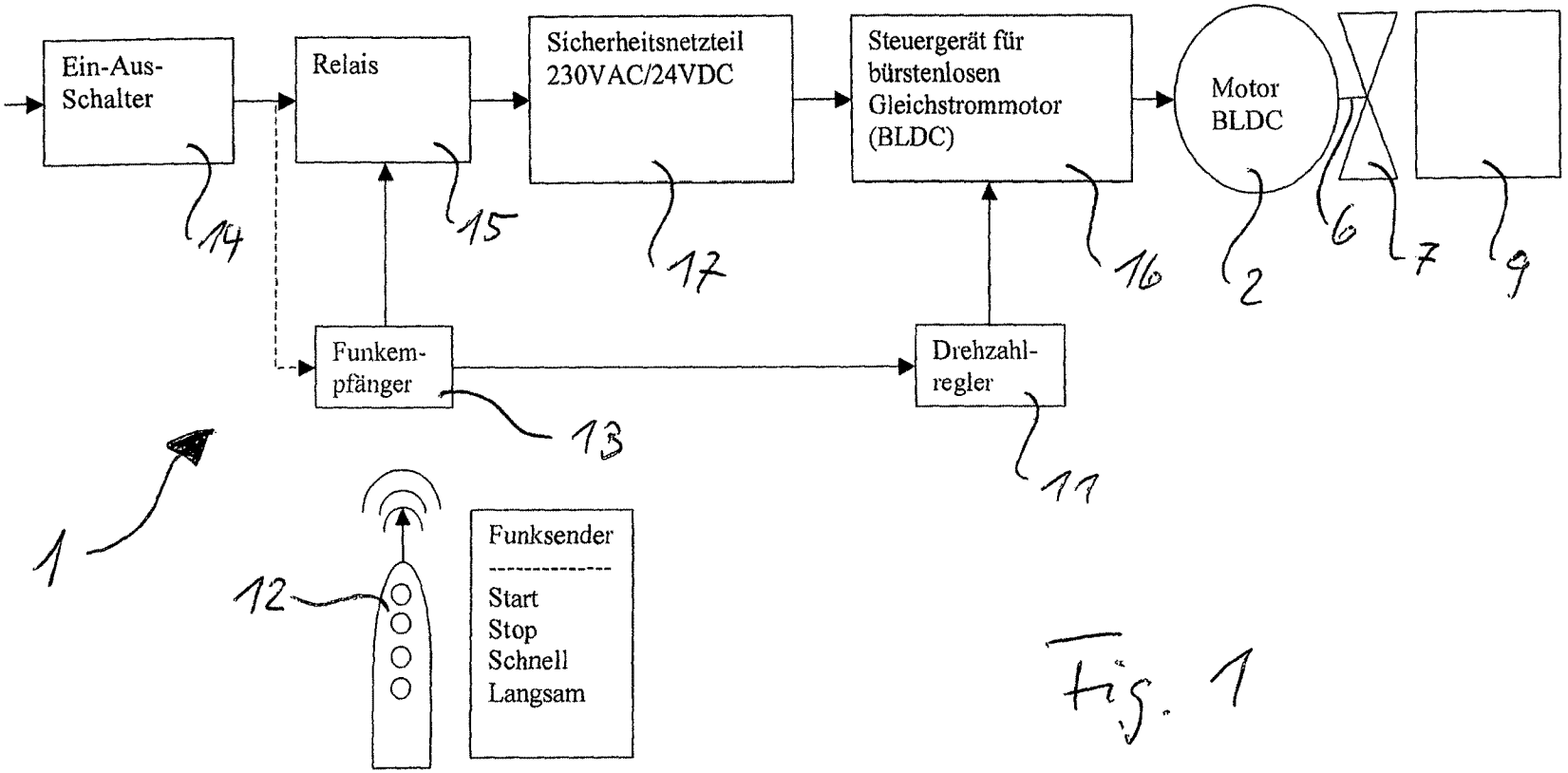
FIG. 1 is a schematic block diagram of a counter-current swimming (1) with its essential structural components.
Figure 2:
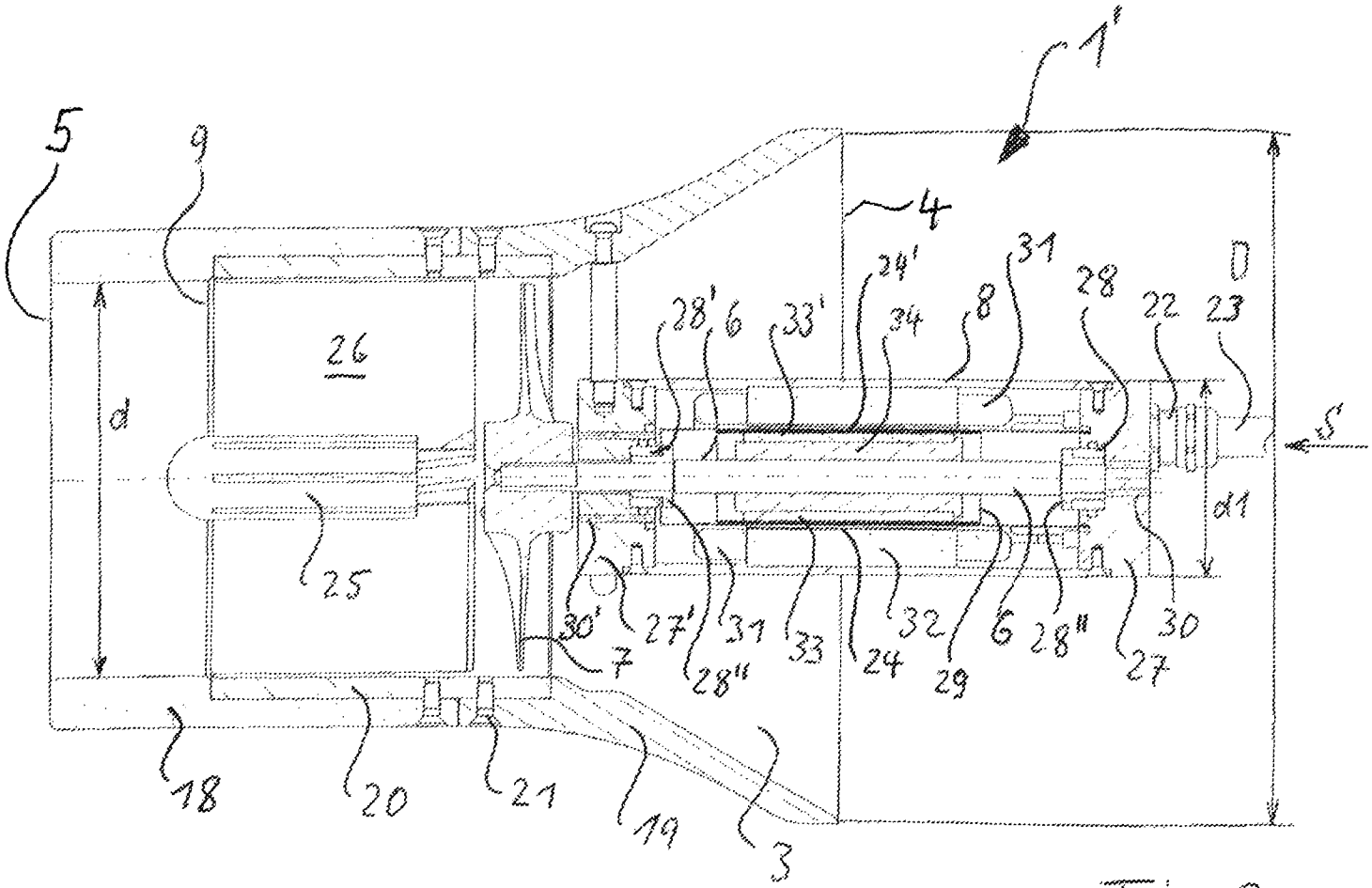
FIG. 2 is a simplified cross-section of the device (1') to the drive (2) in the flow channel (3).

FIG. 1 shows a schematic block diagram of an embodiment of the present invention, a counter-current swimming facility 1 with a drive 2 in a swimming pool not shown herein. The device 1 consists essentially of a drive 2, which is designed as a brushless DC motor and is further described below in more detail. On the shaft 6 2 is a propeller 7, similar to a ship's propeller, attached, the flow (S), s. FIG. 2 in the flow channel produces. Downstream of the propeller 7, at least one directional element 9 is arranged, which provides for maintaining a laminar flow. The flow velocity of the laminar flow is primarily determined by the speed of the drive 2, and the DC motor 8 (FIG. 2). The speed is adjusted by a control unit 16 for sensorless electronically commutated DC motors. The signals for speed adjustment are transmitted wirelessly via radio transmitter 12 to a receiver device 13. The speed controller 11 converts the received signals into a speed setpoint for the controller 16. By means of a radio signal, the relay 15 is operated and turned the power electronics off for energy savings at rest. The switch 14 is manually operated, and switches on the system for a longer time, without current. Between the switching relay 15 and the actual control unit 16 for the DC brushless motor, a safety power supply unit 17 is arranged, which converts the AC input voltage to a safe, corresponding to the regulations DC voltage of 24 volt substantially.

FIG. 2 shows a simplified representation of the device 10 in cross section. The housing, which forms the flow channel 3 is designed in two parts in the present embodiment for reasons of assembly, wherein the one part 18 of a cylindrical shape and the other part 19 is funnel-shaped. The two parts 18, 19 are releasably connected by means of a circular cylinder 20 together with screws 21st Drive 2 is a brushless DC motor, which is designed especially slim and the length is the diameter ratio from 1.3 to 4, preferably at 3.1. The drive 2 about halfway inside the entrance region of the flow channel 3 and about halfway before entering the flow channel 3 is arranged. The power supply of the DC motor 8 via a waterproof insertion stubs 22 through a cable 23 with a suitable insulation. On the shaft 6 of the propeller 7 is so disposed that it locates in the direct initial region of the cylindrical part 18 of the flow channel 3 in the direction of flow S in front of a directional element. 9 The directional element 9 has in the middle of a cylindrical core 25, from the off star-shaped, substantially planar baffles 26 extend up to the inside of the flow channel. 3 The baffles 26 extend in length over about a third of the cylindrical portion 18 of the flow channel 3. For fluidic reasons, the baffles 26 flow inlet side slightly angled at an angle of about 5° in one direction, with the slight bend of the whole baffle 26 extends and thereby affects the laminar flow. On the front side of the flange 27, for. Example, a flow-friendly guide element, not shown here, can be arranged, which reduces the flow resistance to the flow S.

The special DC motor 8 is 'limited, 6 28 the shaft in a bearing 28,' at its ends by two flanges 27, 27 record. The bearing bores are lined each with a bearing sleeve 28" made of a ceramic material on which the shaft ends are supported with an air gap of a few 100ths, so that the stainless steel shaft 6 at a standstill of the DC motor 8 to the ceramic sleeve 28" is supported and during the running of the rotor 29 to form a water film between the sleeve 28" and shaft 6, which minimizes the friction between the two.

The water enters through at least one passage 30, 30' in the flange 27, 27' into the interior of the motor 8, whereby the entire interior of the DC motor is filled with water and 8, the water undergoes a slight circulation. The stator of the DC motor 8 is composed of a coil 31 and a magnetizable iron core 32. The iron core is finished to the hole with a thin-walled sleeve 24 made of carbon or steel. The coil 31 and the iron core 32 are molded together waterproof with a sealing compound. The rotor 29 comprises at least one permanent-magnetic south and north pole 33, 33'. The rotor is coated with a thin-walled sleeve 24' made of carbon or steel. Thus. the resulting centrifugal forces are captured and protected the magnets against corrosion. Rotor magnets and sleeve are sealed, with the same potting compound as in the stator. The permanent magnets consist of a material which has at least a part of rare earth because of their high magnetic field. The permanent magnets 33, 33' are taken up by a rotationally symmetrical carrier 34, which is arranged on the shaft. 6

Figure 3:
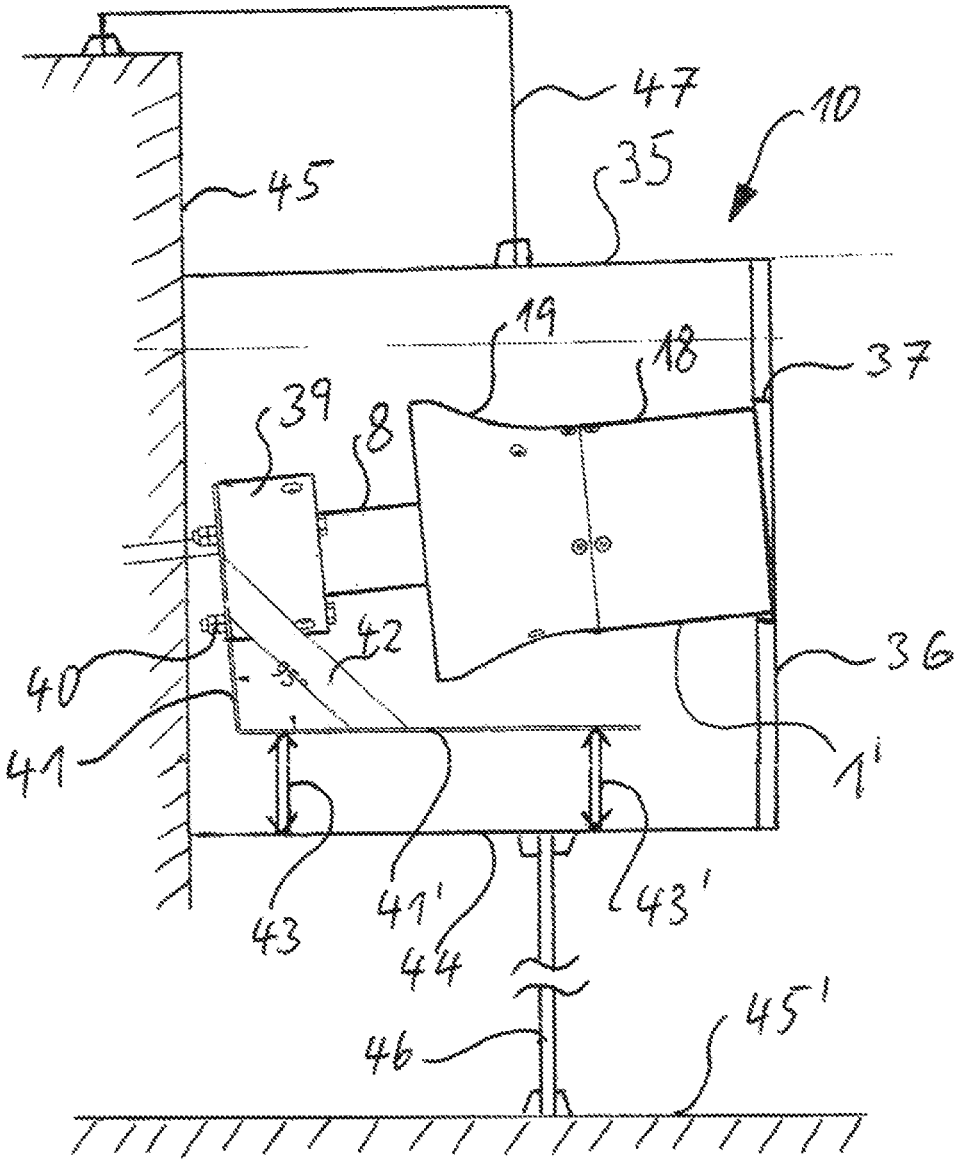
FIG. 3 is a schematic representation of the device (1') in a housing (35) for generating a strong flow S in a counter-current swimming (1).

FIG. 3 shows a schematic representation of the device 10 in a housing 35 for generating a strong flow S of a counter-current swimming 1 by means of device 10. The flow path 3 is formed by two parts 18 and 19, wherein the one part 18 of a cylindrical shape and the other part 19 is funnel-shaped. The underwater propulsion is in the present embodiment, a DC motor 8, which is arranged with its rear end in a spacer 39 and fixed by means of screw connections 40 to a leg 41 of an angle piece. The elbow is made up of two legs 41 and 41' together, wherein the angle between the two legs 41, 41 α' of between 90° and 100° by means of an actuator 42 is variable adjustable. The elbow is made suitably of a non-oxidizing steel. The lower leg 41' rests with the aid of at least three adjustable in their length adjusting elements 43, 43' on the bottom 44 of the housing 35. The housing 35 is generally a parallelepiped-shaped structure made of a suitable non-oxidizing material which expediently on a wall disposed of the pool. The length-adjustable supports 46 below the housing 35, which are between the underbody 44 and the base 45' of the swimming pool is arranged, serve the interception of the weight of the device 10 and the housing 36. Another strut 47 above the housing 35 also provides the possibility to fix the housing 35 on the pool edge in order to keep the weight in equilibrium and to absorb vibrations of the housing 35. On the front side of the housing 35, a special closing element 36 is arranged, which serves both as suction as well as discharge means of the fluid flows, wherein the area of the outlet opening of the flow channel 3 is nearly in the plane of the terminal element 36, which, inter alia, leads that possible turbulence of the liquid medium at the edges of the outflow opening of the flow channel 3 do not arise because they immediately are absorbed by the immediately adjacent sucking area 49, 49' of the seal 36 again and the funnel-shaped part 19 fed the flow channel 3 are, The angle of the direction of flow to the surface of the water level is adjusted by means of the actuators 42, 43, 43' and is aimed, inter alia, to according to the length of the pool.

Figure 4:
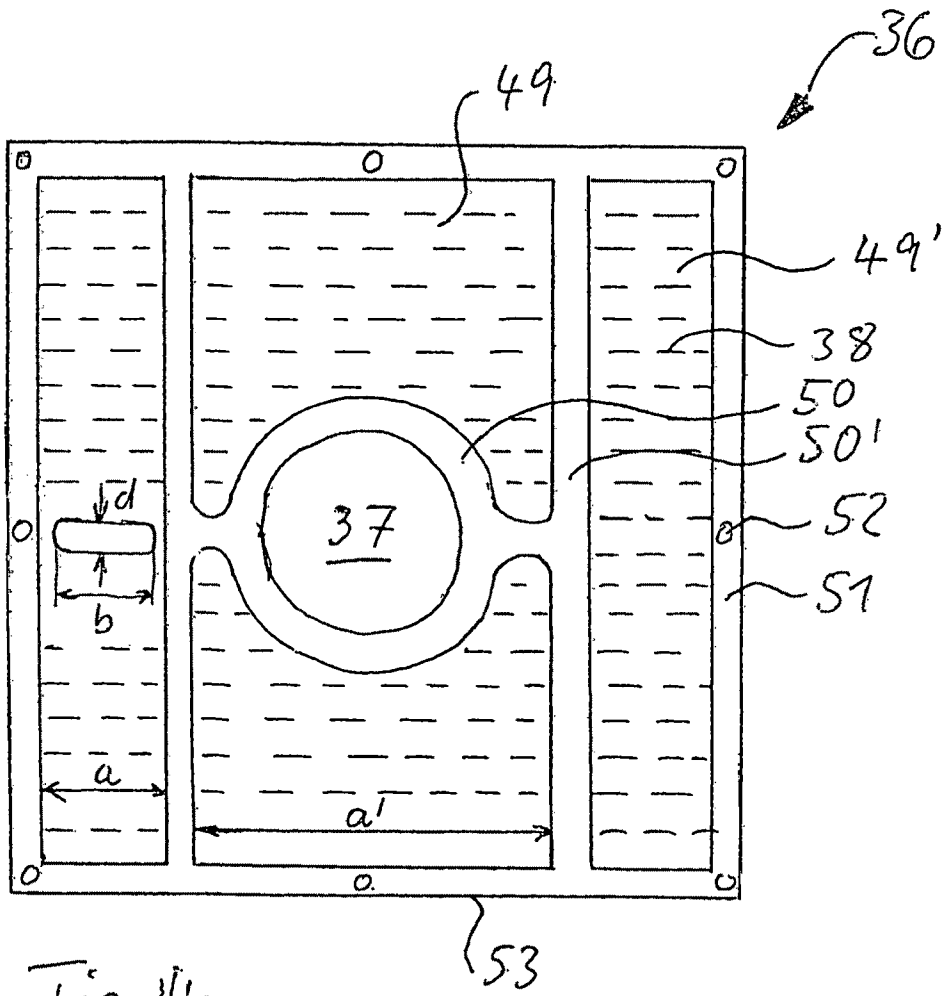
FIG. 4 is a front view of the end panel (36) with at least one outlet recess (37).

The FIG. 4 shows a front view of the end panel 36 with at least one outlet opening 37 and a plurality of suction slots 48, which are divided into different areas 49, 49. The different regions 49, 49' are with liquid impervious areas 50, 50' separated from each other, wherein these regions are 50, 50 spaced apart' with a predetermined distance a, a' from each other to ensure that at a predetermined slot diameter d and a to determining slit width b a predetermined flow rate of fluid (e.g., water.) 160-170 may $m^3/h$ flow through a maximum. The determination of the flow rates at various points of the closing element 36 is in terms of security and functionality of the system is of decisive importance.

It is important to determine the flow rate at different points of the nozzle outlet. This is in the area of the nozzle center max. 3.7 m/s and in the region of the nozzle rim 3 m/s. The nozzle exit velocity corresponds to the requirements of DIN EN 13451-3. The intake grille is flush mounted on the front of the installation housing 35.

The measurement of the suction velocity v to the individual slot-shaped openings was carried out at different locations of the different areas 50, 50'. The maximum occurring at a speed of passage volume of about 170 square meters/hr to the individual openings is 0.45 m/s.

The suction speed v to the individual openings is derived from the ratio of the total flow to freely permeable surface area, According to DIN EN 13451-3 is assumed that due to soiling construction deviations the aspiration of the individual openings 0.4 m/s shall not exceed at an existing suction. This requirement is ensured when the total flow rate of $Q=160\ m^3/h$ is not exceeded. This volume flow thus corresponds to the volume flow of the counter-current swimming, so that the requirements are met in the DIN regulations if the number of slots and their geometrical dimensions achieves a total suction of 0.11 square meters. The easy flow arrangement of the individual recesses plays a crucial role.

Approximately centrally a circular recess 37 is arranged in the closure element 36 in the present embodiment, the approximately to the diameter d corresponds to the outlet nozzle. This recess 37 is surrounded by a liquid-impermeable portion 50 which delimits the outflow of fluid from the suction of the fluid, thereby avoiding that affect the opposite currents mutually disturbing. The closure element 36 is mounted with its rim 51 with a plurality countersunk screws 52 to the housing 35.

Figure 5:
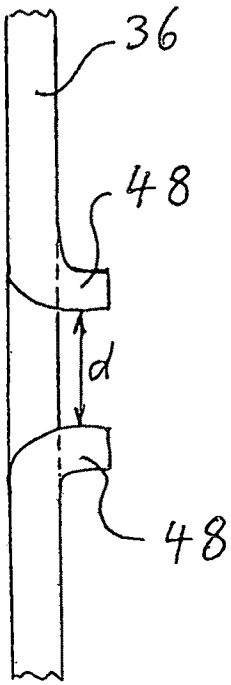
FIG. 5 is a schematic sectional view through the immediate vicinity of a recess (38) in the closure member (36) of the housing (35)

The FIG. 5 shows a schematic enlarged sectional view through the immediate vicinity of a recess 38 in the end element 36 of the housing 35. The material for the elaboration of the recess 38 is deformed laterally, thus forming a ridge 48, 48', the length of the half of the slot diameter d is dependent and thus contributes to the stability of the entire closing element 36. The slot diameter d and the slit width b determine the total flow Q of the sucked liquid medium.

Figure 6:
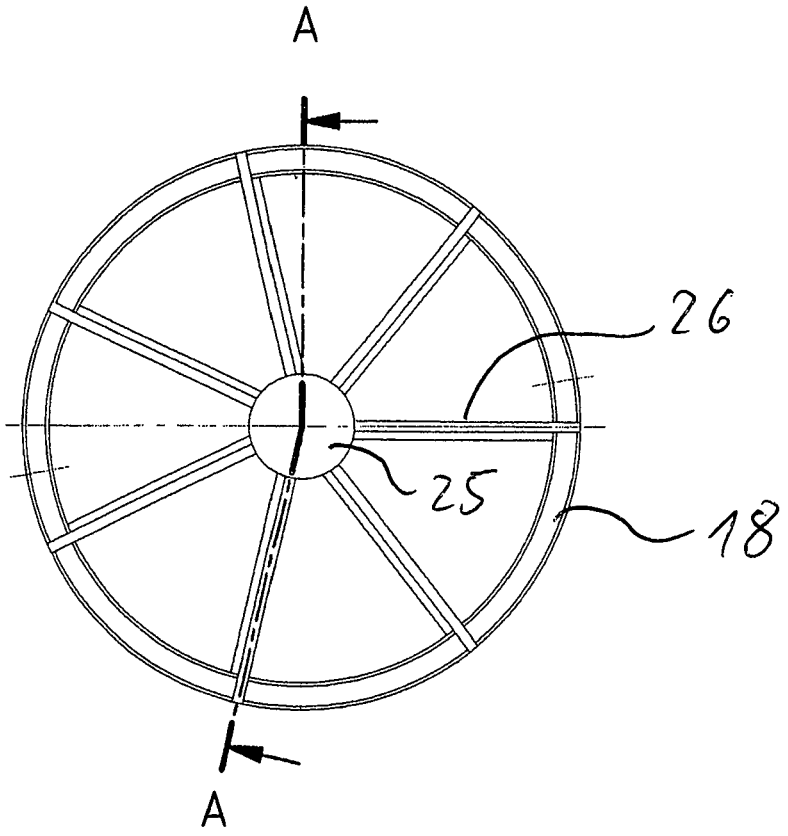
FIG. 6 is a front view of the flow guide (26) in the cylindrical part (18) of the flow channel (3).

In FIG. 6 is a front view of the flow directing elements 9, 26 is shown in the cylindrical part 18 of the flow channel 3. The flow directing elements 9, 26 are on the one hand to a core piece 25 and the other hand on the cylindrical part 18 of the flow channel 3 by conventional means, e.g. Slots attached. The number of the flow determines the calming of the liquid flow, d. H. The degree of quasi laminar flow in the swimming pool and the bend in the flow straightening elements determines the divergence and the direction of flow S after leaving the nozzle orifice. With an average flow rate of about 1.2 m/s (corresponding to 4.3 km/h) in the pool seven flow guide 9, 26 are useful to reduce the beam expander to a reasonable level and the direction of constancy of flow S in the pool guarantee.

The measured speed value in the center at the exit of the flow channel 3 is 3.7 m/s. The observed beam expansion in the test tank was conducted visualized by aeration. The beam expansion is very limited, so that a high flow in the pool enters concentrated. Thereby, the floating effect is considerably improved. For a sporty swimming is a speed of e.g. 1.2 m/s (corresponding to 4.3 km/h) is sufficient.

It has been found that the exiting flow by means of a diffuser having a predetermined number of curved flow directing elements 9, 26 is expanded such that in addition to a larger flow field is also a uniform distribution of the flow rate is available.

With respect to the flow field are taken as a guide, the dimensions of the shoulder width of about 60 cm and a depth of 30 cm zoom pull to get the principle of a flow channel closer. Compared with conventional counter-current swimming establishments or floating channels of present underwater drive 8 can be viewed on the energy efficiency and extremely low with respect.

With the present invention, there is thus a counter-current swimming facility 1 residential pool in a highly efficient drive motor 8 merged with wear-free sealing system in a housing 35 with a device 10 for generating the flow of water south for training in a swimming pool to a suitable unit.

SUMMARY

The present invention provides a swimming pool having an integrated counter-current swimming facility (1) comprising a device (10) for generating a strong adjustable flow in the water, which has a compact design with a relatively low power consumption. The apparatus (10) having a brushless underwater DC motor (8), which is disposed in the entering portion of a flow channel (3), is arranged in a housing (35) having an end element (36) at the front, wherein the exit face of the flow channel (3) in the device (10) is almost flush in the plane of the shaped end element (36). The underwater DC motor (8), and thus the drive (2) is of a slim design, wherein the geometric ratio of the length thereof to the diameter of the drive housing should not be less than 3.3.

For this purpose, FIG. 3

The invention claimed is:

1. A swimming pool having integral counter-current swimming system (1) including a device (1') for generating a strong flow adjustable by means of a flow channel (3) in a liquid medium, and is arranged in a housing (35), wherein the outlet surface of the flow channel (3) of the device (1') is disposed substantially in alignment in the plane of a shaped closing element (36) and the strong flow of the liquid medium is generated by a device (1') almost half in an underwater drive (2) in the entry region of the flow channel (3) having an inlet and outlet openings (4, 5), wherein the drive comprises a DC-motor and the housing of the underwater drive (2) is arranged a half in the flow channel (3) wherein the flow channel in this region has a diameter ratio D/d of the entry opening (4) to the outlet opening (5) which is not less than 1.7, the outlet opening (5) is unobstructed, and the underwater drive (2) has a length to diameter ratio of from 2 to 4 and the surface of the formed closing element (36) is divided in at least two regions (37, 49), wherein the at least one recess (37) for the outlet opening of the flow channel (3) is approximately centrally disposed in the surface of said formed closing element (36); and the angle of the flow direction to the surface of the liquid medium level is adjusted by means of actuating members (42, 43, 43') substantially within the plane of the closing element (36).

2. The swimming pool having integral counter-current swimming system (1) according to claim 1, characterized in that the closing element (36) has a plurality of recesses (38), whose total a volume flow from 50 to 160 $m^2$/h and a suction velocity V of the individual openings of not greater than 0,45 m / s guaranteed.

3. The swimming pool having integral counter-current swimming system (1) according to claim 1, characterized in that the clear width or diameter of a single recess (38) is not greater than 8 mm.

4. The swimming pool having integral counter-current swimming system (1) according to claim 1, characterized in that flow direction behind the propeller (7) of the underwater drive at least one aligning element (9, 26) is arranged, which largely prevents a turbulence of the fluid flow.

5. The swimming pool having integral counter-current system (1) according to claim 1, characterized in that closing element (36) an acting perpendicular to the surface mechanical stress of at least 1390 N resists according to 140 kg without showing permanent deformations.

6. The swimming pool having integral counter-current swimming system (1) according to claim 1, characterized in that the individual liquid medium permeable regions (49, 49') by liquid impermeable medium webs (50, 50') from each other.

7. The swimming pool having integral counter-current swimming system (1) according to claim 1 characterized in that the areas (49, 49') slit-shaped breakthroughs, the slot diameter d is not greater than 8 mm, preferably 7 mm.

8. The swimming pool having integral counter-current swimming system (1) according to claim 1, characterized in that the end element (36) inwardly pointing web (48,48'), which are preferably arranged at the edges of the elongated slots (38).

9. The swimming pool having integral counter-current swimming system (1) according to claim 1, characterized in that the flow channel (3) and the underwater drive (8) are substantially held by two angled limbs (41,41'), one of which for securing the underwater drive (8) is used, wherein the angle a between the two legs (41,41') is adjustable between 90° and 100°, preferably at 95°.

10. The swimming pool having integral counter-current system (1) according to claim 1, characterized in that the diameter D of the inlet opening (4) is between 160 mm and 300 mm, preferably 250 mm and the diameter Dl of the outlet opening (5) is between 100 mm and 200 mm, preferably at 143 mm.

11. The swimming pool having integral counter-current system (1) according to claims 1, characterized in that the drive (2) is designed as a brushless DC motor (8) and with a wear-free sealing system is formed, the rotor (29) at least two magnetic elements (33,33') which produce a strong permanent magnetic field H.

12. The swimming pool having integral counter-current system (1) according to claim 1, characterized in that at least one aligning element (9) is arranged in the flow channel (3), which largely prevents a turbulence of the fluid flow.

13. The swimming pool having integral counter-current system (1) according to claim 1, characterized in that the magnetic elements (33, 33') and the stator (32) of the electric drive (2) are embedded in a casting compound.

14. The swimming pool having integral counter-current swimming pool system (1) according to claim 1, wherein the magnetic field H of the stator (32) is generated due to an electronic controller (16) and the rotational speed is infinitely variable.

15. The swimming pool having integral counter-current system (1) according to claims 1, characterized in that the drive (2) comprises a DC motor, wherein a shaft (6) of a rotor (29) between two bearings (28, 28') of bearing sleeves (28") is a ceramic material, and during the running of the rotor (29) between the bearing sleeves (28") and bearings (28, 28') forms a film of water.

16. A method for generating a strong adjustable flow in a liquid medium, in a swimming pool, having a counter-current swimming system (1) according to claim 1 consisting of the following steps:

generating the strong adjustable flow by the device (1') by means of a flow channel (3) in the liquid medium, encasing the flow channel in the housing (35), aligning the outflow plane of the flow channel (3) of the device (1') in the plane of the shaped closing element (36), and adjusting the angle of the flow direction to the surface of the liquid medium level is by means of the actuating members (42,43,43 ') substantially within the plane of the closing element (36).

* * * * *